United States Patent [19]

Maehara

[11] Patent Number: 4,783,682

[45] Date of Patent: Nov. 8, 1988

[54] COPY PAPER DELIVERY TIMING CONTROL DEVICE

[75] Inventor: Shigeharu Maehara, Nara, Japan

[73] Assignee: Sharp Kabushiki Kaisha, Osaka, Japan

[21] Appl. No.: 835,743

[22] Filed: Mar. 3, 1986

[30] Foreign Application Priority Data

Mar. 4, 1985 [JP] Japan ..... 60-43294

[51] Int. Cl.[4] ..... G03G 15/00

[52] U.S. Cl. ..... 355/14 SH; 355/8; 355/14 R; 355/57

[58] Field of Search ..... 355/8, 14 SH, 14 R, 355/14 C, 55–57

[56] References Cited

U.S. PATENT DOCUMENTS

| | | | |
|---|---|---|---|
| 4,098,551 | 7/1978 | Komori et al. | 355/3 R |
| 4,260,241 | 4/1981 | Honma et al. | 355/14 R |
| 4,461,564 | 7/1984 | Ikenoue | 355/8 |
| 4,547,062 | 10/1985 | Fujiwara | 355/14 R |
| 4,595,273 | 6/1986 | Watanabe et al. | 355/8 X |
| 4,595,286 | 6/1986 | Yamazaki | 355/14 R X |

FOREIGN PATENT DOCUMENTS

| | | | |
|---|---|---|---|
| 2605822 | 8/1976 | Fed. Rep. of Germany . | |
| 2919784 | 11/1979 | Fed. Rep. of Germany . | |
| 3322872 | 1/1984 | Fed. Rep. of Germany . | |
| 57-111547 | 7/1982 | Japan | 355/8 |

*Primary Examiner*—Arthur T. Grimley
*Assistant Examiner*—J. Pendegrass
*Attorney, Agent, or Firm*—Birch, Stewart, Kolasch & Birch

[57] ABSTRACT

Disclosed is a copy paper delivery-timing control device which includes the following: a home position sensor that detects the home position of the original scanner; a pulse-generator for generating a specific number of pulses corresponding to the travelling distance of the scanner; a counter that activates counting of a specific number of pulses when the scanner passes through its home position; a timer for activating counting as soon as the value of the counter exactly matches a specific value denoting the tip position of the original; a device for starting transfer of copy paper to the transference position as soon as the timer fully counts up the predetermined time; and a control device for activating the timer when the "1-set/2-copy" mode is entered for continuously copying both the left half and the right half of the original on individual copying papers. In this mode, the timing for activating the timer is set when the value of the counter exactly matches the value corresponding to the tip position of the right half of the original before eventually copying the right half of the original.

2 Claims, 4 Drawing Sheets

COPY PAPER DELIVERY TIMING CONTROL DEVICE

BACKGROUND OF THE INVENTION

The present invention relates to a device for controlling the timing needed to align the tip position of an image formed on the photoreceptive drum with the tip position of the copying paper in a zooming electrophotographic copying machine in which the magnification ratio is freely adjusted.

When operating any conventional electrophotographic copying machine, it is necessary to correctly align the tip position of the image formed on the photoreceptive drum with the tip position of the copy paper before forming the original image on the photoreceptive drum and thereafter transferring the image from the drum to the predetermined position of the copying paper. If the travelling scanner could detect its arrival at the tip position of the original paper, since the photoreceptive drum rotates at a constant speed, the tip position of the image on the drum can be aligned with the tip position of the copy paper at the transference position. In a copying machine which is provided with an actual-size magnification ratio, the original scanner travels at a constant speed. Thus, the scanner reaches the tip position of the original paper from the home position at a constant time. As a result, when operating a copying machine provided with the mechanisms mentioned above, the paper-feeding time can be controlled so that the tip position of the copy paper can reach the transference position exactly at the moment obtained by adding the time in which the scanner reaches the tip position of the original paper via its home position and the time needed for the image when the scanner reaches the tip position of the original paper, to move from the drum to the transference position. Conversely, when operating a copying machine which is capable of providing several magnification ratios, depending on the ratio, the travelling speed of the scanner varies. Accordingly, the time needed for the scanner to arrive at the tip position of the original paper via its home position also varies.

SUMMARY OF THE INVENTION

The present invention provides a novel device for controlling the timing needed for feeding copy paper. It sufficiently retains its original accuracy even when magnification adjustment is underway. The device embodied by the present invention enables adjustment merely by the operation of a timer and a counter. This is true even if this device is applied to either a variable ratio copying machine or a zooming copying machine. In addition, it has the capability of correctly aligning the tip position of the right-half of an original paper with the tip position of the copy paper merely by operating a timer and a counter when entering a mode for continuously copying the left-half and the right half of the original paper on individual copying papers.

To summarize, the present invention is comprised of the following: means for generating a specific number of pulses enough to define the travelling distance of the original scanner; means for measuring the travelling distance of the original scanner by computing the number of pulses; means for correctly identifying the tip position of the original paper even when the travelling speed of the scanner varies in accordance with the magnification ratio; and means for correctly identifying the tip position of the right half of the original paper by reading the counter value independent of the magnification ratio when entering a mode for continuously copying the left half and the right half of the original paper on individual copy paper.

BRIEF DESCRIPTION OF THE DRAWINGS

The present invention will be better understood from the detailed description given hereinbelow and the accompanying drawings which are given by way of illustration only, and thus are not limitative of the present invention, in which:

DETAILED DESCRIPTION OF THE PREFERRED EMBODIMENTS (A) Construction of the paper-feeding timing control device FIG. 2 is a simplified block diagram of a zooming electrophotographic copying machine incorporating the copy paper delivery timing control device embodied by the present invention. Reference numeral 1 denotes an electrophotographic copying machine on which is mounted an original table 2. Cassettes 3 and 4 storing the copying paper and a paper discharge tray 5 are set to the right and to the left of the copying machine 1, respectively. A photoreceptive drum 6 rotating clockwise is installed close to the center of the copying machine 1. A toner collecting container 12, a first charger 7, a developer 8, an image transferring unit 9, a paper-stripping unit 10, a discharger 11, and a blade 12*a*, are installed so that these components surround the photoreceptive drum 6. The optical unit that focuses the image of the original onto exposure point "a" of the photoreceptive drum 6 comprises four (4) reflection mirrors 13 through 16 and a lens 17. The original scanner is substantially comprised of reflection mirrors 13 through 15, a light source (not shown) illuminating the original, and a light-shielding plate 18. The light-shielding plate 18 passes a mirror home-position sensor (hereinafter called the MHP sensor) 19 set in the upper-left of the copying machine 1. When the light-shielding plate 18 crosses the MHP sensor 19, the counter is activated. The original scanner is driven by a motor while the shaft of the motor is provided with a rotary encoder not shown in the drawings. Whenever the scanner moves a specific distance, the rotary encoder generates a pulse. The controller identifies the distance travelled by the scanner by counting the number of pulses from the rotary encoder. Position A shown in FIG. 2 indicates the tip position of the original paper. In FIG. 2, the travelling speed of the scanner is denoted by NF, whereas the speed of the rotation of the photoreceptive drum 6 is denoted by ND. The magnification ratio can be changed by modifying the speed ratio between the travelling speed of the scanner NF and the rotation linear speed of the photoreceptive drum 6. When the magnification ratio is 1, ND/NF=1. When the ratio is 0.64 times the actual size, ND/NF=0.64. Conversely, when the ratio is 1.41 times the actual size, ND/NF=1.41. Since the rotation speed ND of the photoreceptive drum 6 is held constant, the travelling speed NF of the scanner is modified in order to generate the speed ratio shown above. Eventually, when the ratio is 0.64 times the actual size, NF=ND/0.64, and likewise, when the ratio is 1.41, NF=ND/1.41.

Figure 1:
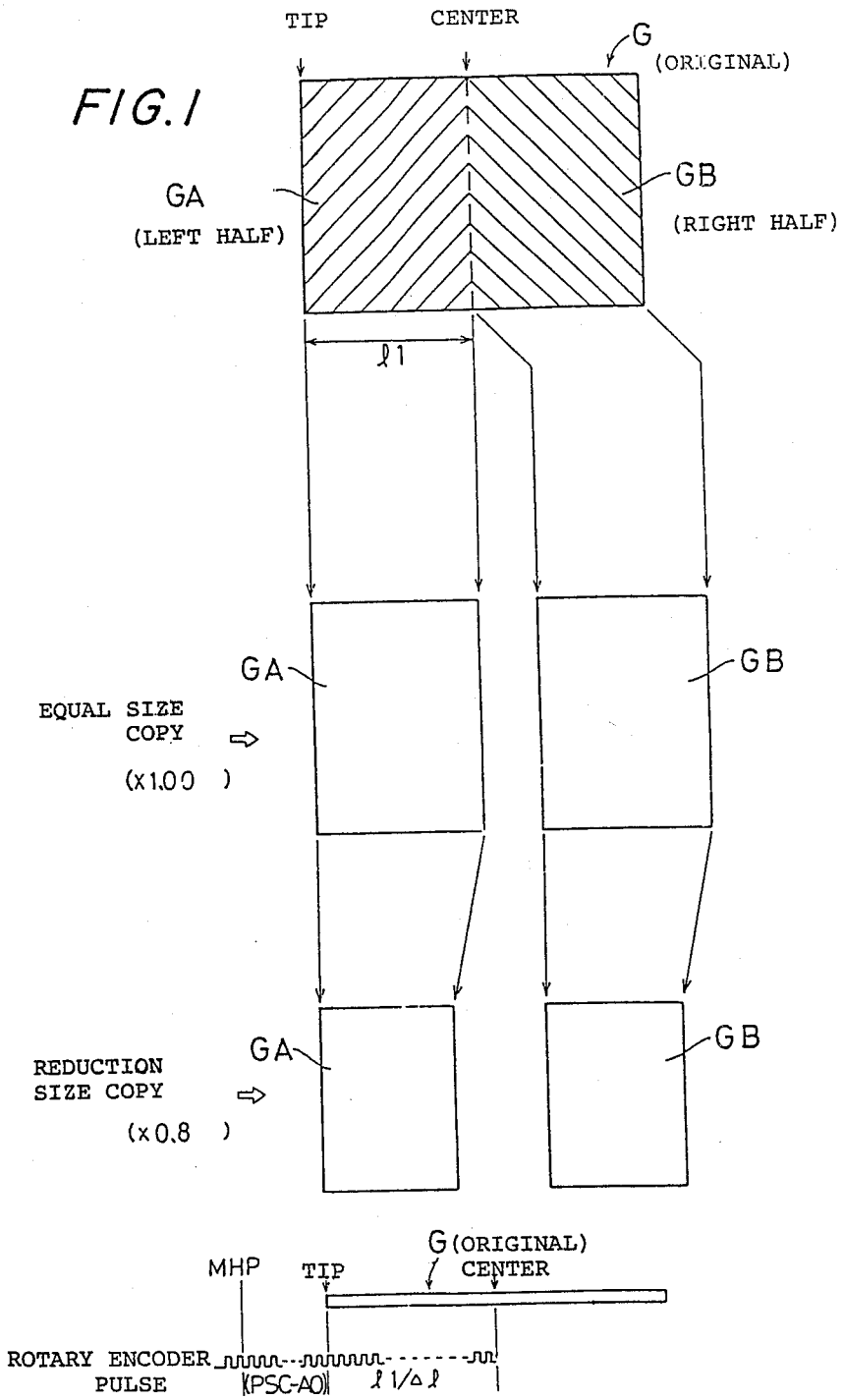
FIG. 1 is the schematic diagram explaining the method of controlling the timing needed for feeding copying paper using the "1-set/2-copy" mode in the device embodied by the present invention.

After being delivered from cassette 3 or 4 via a paper-feeding roller (20 or 21), the copying paper stops once at a paper-stop roller (hereinafter called the PS roller) 22. A switch 23 detects that the tip position of the copying paper is exactly at the position of the PS roller 22. In other words, as soon as the switch 23 detects the arrival of the tip position of the copying paper at the PS roller 22, the paper-feeding roller 20 or 21, stops operating.

Figure 3:
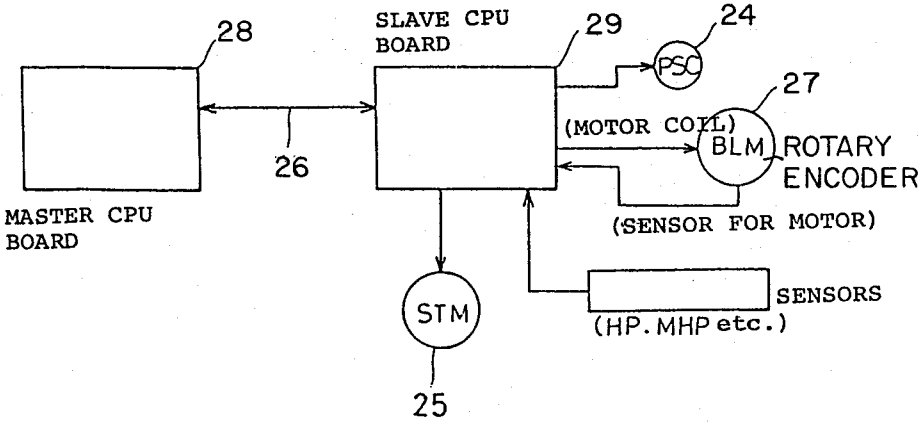
FIG. 3 is a simplified block diagram of the scanner controller of the copying machine shown in FIG. 2.

FIG. 3 is a simplified block diagram of the scanner controller. Operations of the zooming electrophotographic copying machine incorporating the preferred embodiments of the present invention are controlled by both a master CPU board 28 and a slave CPU board 29, which are connected to each other via a communication cable 26. The slave CPU board 29 controls a mirror motor BLM 27 driving the original scanner, a solenoid PSC 24 driving the PS roller 22, and a lens-driving motor STM 25. At the same time, the slave CPU board 29 receives a variety of signals from a number of sensors, such as, the motor sensor (including rotary encoder) installed in the rotary shaft of the mirror motor 27, the MHP sensor detecting the home position of the original scanner, the HP sensor (not shown) detecting the home position of the lens 17.

(B) Operation of the paper-feeding timing control device

Figure 4:
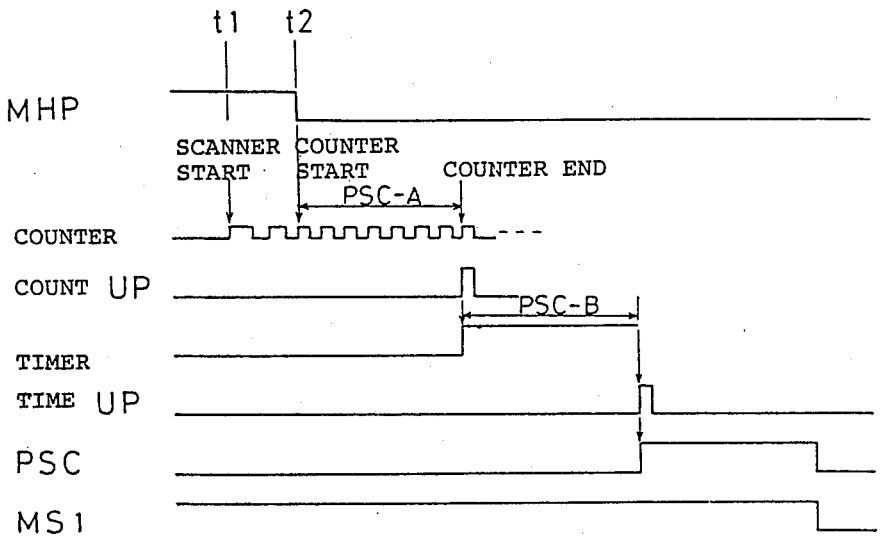
FIG. 4 is a time chart denoting the copy paper feed timing in the normal copying mode.

FIG. 4 is a time chart denoting the control operations executed by the slave CPU board 29. First, control of the copying machine dealing with normal original paper is described below. When the copy start button (not shown) is pressed after setting normal original paper on the original table 2, the original scanner starts to shift its position from the MHP sensor 19. The travelling speed is dependent on the magnification ratio predetermined by the operator. The travelling speed NF is set only after the slave CPU board 29 receives the magnification data from the master CPU board 28. The slave CPU board 29 then computes the received magnification data and determines the travelling speed NF for the original scanner, which then activates the mirror motor 27 to shift the scanner to the right. The light-shielding plate 18 passes the MHP sensor 19 at a specific moment. Assume that this moment is t2 and the moment at which the scanner starts its movement is t1. The slave CPU board 29 incorporates a counter and a timer, while it causes the counter to start counting the number of pulses from the rotary encoder simultaneous with the moment t2. As described earlier, independent of the magnification ratio, the distance from the MHP sensor 19 to the tip position of the original paper is constant. As soon as the counter counts up the number of pulses corresponding to the distance between the MHP sensor 19 and the tip position of the original paper, the slave CPU board 29 acknowledges that the scanner has arrived at the tip position A of the original paper. The slave CPU board 29 receives from the master CPU board 28 the countable value corresponding to the specific distance between the MHP sensor and the tip position of the original paper mentioned above and then sets this value to the counter inside the slave CPU board 29. Assume that this countable value is PSC-A. The slave CPU board 29 subtracts 1 from the countable value whenever it receives a pulse from the rotary encoder and when the counting value becomes zero, it generates the counted signal. The slave CPU board 29 identifies by means of the counted signal the fact that the original scanner is at the tip position A of the original paper. Simultaneously, the picture at the tip position of the original paper is exposed to light at exposure point "a" of the photoreceptive drum 6.

Figure 2:
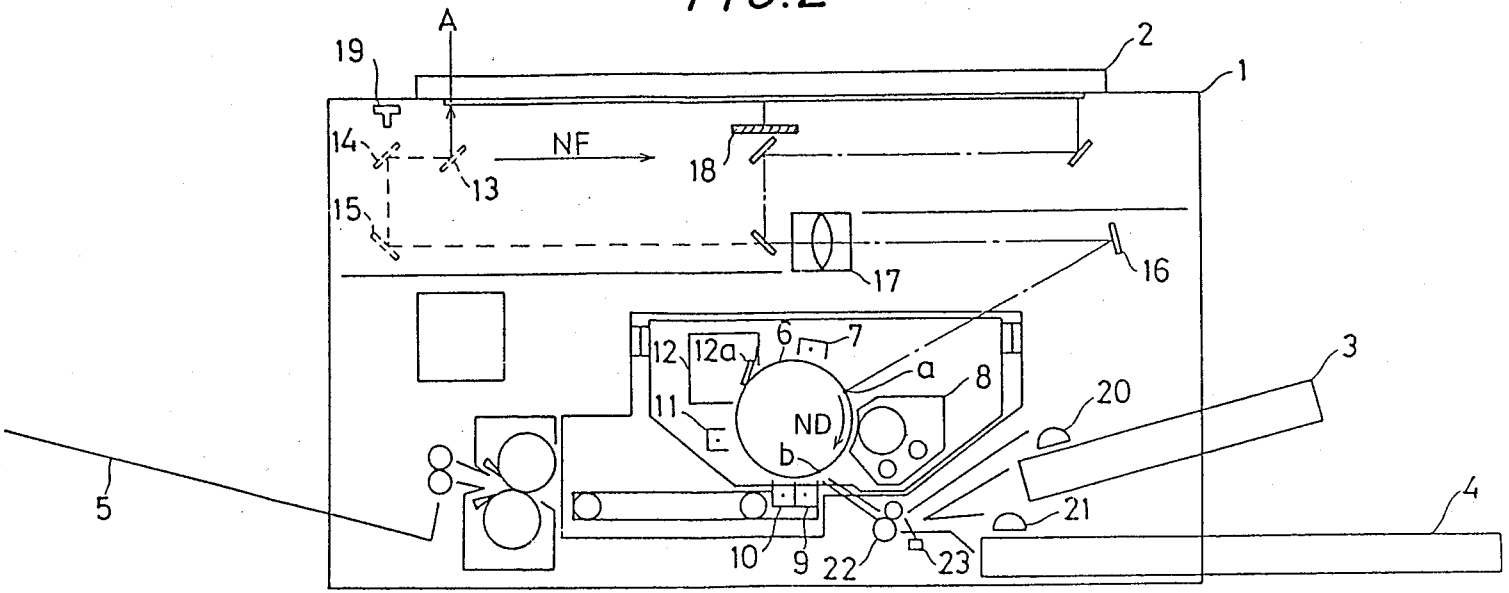
FIG. 2 is a side view illustrating an electrophotographic copying machine incorporating the paper-feeding timing control device embodied by the present invention.

When the counted signal is generated, the timer inside the slave CPU board 29 is activated. This timer adjusts the time needed for the image at exposure point "a" to arrive at the transference point "b" (see FIG. 2) and the time needed for the tip position of the copy paper at the PS roller 22 point to also arrive at the identical point "b." Accordingly, the timer operating period corresponds to the remaining value after subtracting the time needed for the tip position of the copy paper at the PS roller 22 to arrive at transference point "b" from the time needed for the picture on the photoreceptive drum 6 to move from exposure point "a" to transfer point "b". Assume that the timer operating period is PSC-B. Once the timer is activated and the PSC-B period expires, the slave CPU board 29 detects the time counted signal and activates a clutch (PSC 24) of the PS roller.

By execution of these control operations, the tip position of the image formed on the photoreceptive drum 6 can be aligned with the tip position of the copy paper at transference position "b." When magnification ratio changes, the travelling speed NF of the original scanner also varies. However, since each pulse is generated by the rotary encoder independent of the travelling speed NF of the scanner, whenever the original scanner travels a specific distance, the counted signal is generated simultaneous with the arrival of the original scanner at the position A. Consequently, even when zooming, the tip positions of both the original picture and the copying paper are always aligned with each other at transference position "b."

Next, the functional operations of the copy-paper delivery timing control devices under the "1-set/2-copy" mode are described below. FIG. 1 is the schematic diagram explaining the method of controlling the copying operation under "1-set/2-copy" mode. As shown in FIG. 1, while the "1-set/2-copy" mode is underway, original contents GA in the left half of the original G is copied onto the first sheet of copy paper, whereas the original content GB in the right half of the original G is copied onto the second sheet of copy paper. The scanner completes one scanning operation over the original G. The tip position of original contents GA in the left-half of original G are aligned with the tip position of the first sheet of copy paper by applying the control operations described earlier. However, since the tip position of the original content GB in the right half of the original G does not match the tip position A of the original on the original table, neither tip position can be aligned with each other by directly applying the control operations described earlier. To compensate for this, the original contents GB in the right half of the original are dealt with by the means described below. The length of the original content GA in the left half of the original G is equal to that of the original content GB in the right half. Each half is denoted in terms of "l1." The "l1" length is automatically computed by the controller of an electrophotographic copying machine provided with an automatic draft-size detection function, whereas the manually operated copying machine calculates the "l1" length by dividing the original size data fed by the operator by 2. On receipt of the "l1" length, the master CPU board 28 then delivers a data value (PSC - A0) +l1/Δ1 to the slave CPU board 29, which then sets this value to the internal counter. The PSC - A0 represents the number of pulses corresponding to the distance from the MHP sensor 19 to the tip position A of the original paper when copying is done in the normal mode. It denotes the amount of travel per pulse by the scanner. Since this value is stationary, l1/Δ1 indicates the number of pulses corresponding to the travelling distance of the scanner from the tip position of the original on the original table to the tip position of the original contents GB in the right half of the original G. By setting the number of pulses denoted by data (PSC - A0) +l1/Δ1, the slave CPU board 29 can eventually control the original content GB on the right half as it controls the original content GA on the left half of the original G. The slave CPU board 29 generates the counted signal just as the number of pulses corresponding to the absolute distance to the center position of the original G are counted after the counter begins counting the pulses which are generated by the rotary encoder. Next, the PS roller 22 is activated by the timing shown in FIG. 4. Consequently, independent of the magnification ratio, even when the "1-set/2-copy" mode is entered, it is possible for the system to correctly align the tip positions of the copying papers with the tip positions of both original contents GA and GB at transference position "b." When the "1-set/2-copy" mode is entered, the preferred embodiment allows the counter inside the slave CPU board 29 to set a specific number of pulses corresponding to the value (PSC - A0) +l1 Δl. The means for setting a specific number of pulses constitute the timer-setting means in the "1-set/2-copy" mode.

As described above, the preferred embodiment of the present invention provides a home-position sensor that detects the home position of the original scanner and means for generating a specific number of pulses corresponding to the travelling distance of the scanner, in which the means is generated, for example, by a rotary encoder which generates a specific number of pulses which exactly correspond to the travelling distance of the original scanner independent of the travelling speed of the scanner. The preferred embodiment also provides a counter that starts counting the pulses generated by the pulse-generating means just as the scanner passes through its home position. Using this counter, the built-in CPU identifies the travel length of the scanner from its home position. Independent of the counter, a timer is provided, which begins counting time as soon as the counter value matches a specific value corresponding to the tip position of the original. In other words, the timer is activated as soon as the counter fully counts up the specific number of pulses that exactly match the distance covered by the travelling scanner from its home position to the tip position of the original. Specifically, the timer is used to correctly match the alignment timing of the tip position of the image formed on the photoreceptive drum with the tip position of the copying paper. Since the rotation speed of the photoreceptive drum is constant, independent of the magnification ratio and the copying paper is also transferred at a constant speed, if the tip position of the image on the drum is determined, the timing needed to feed the copying paper from a specific position can be definitely determined. Taking this into account, the preferred embodiment of the present invention provides a means of transporting the copying paper to the transference position as soon as the timer fully counts up the predetermined time. Thus, the above construction enables the system to correctly align the tip position of the image on the photoreceptive drum with the tip position of the copying paper merely by operating a counter and a timer independent of the magnification ratio.

When activating the "1-set/2-copy" mode for continuously copying the original contents of the left half and the right half of the original on individual copy paper, the preferred embodiment provides means for setting the timer-activating timing at the precise moment when the value counted by the counter matches the tip position of the right half original content before copying the said content. Specifically, since the travelling distance of the original scanner exactly matches the value counted by the counter, the control system activates the timer as soon as the counter fully counts up the predetermined number of pulses corresponding to both the distance between the count-starting home position of the original scanner and the tip position of the left-half of the original content, and the number of pulses corresponding to one-half the full length of the original. By effectively controlling these operations, the tip position of the right half of the original content and the tip position of the copy paper can be easily aligned with each other. According to the present invention, it is possible for the copying system to precisely and securely align the tip position of the image formed on the photoreceptive drum and the tip position of the copying paper independent of the magnification ratio merely by providing a counter and a timer. Furthermore, in the "1-set/2-copy" mode, it is possible for the system to align the tip position of the right-half original and the tip position of the copying paper independent of the magnification ratio merely by modifiying the timer-activated timing.

While only certain embodiments of the present invention have been described, it will be apparent to those skilled in the art that various changes and modifications may be made therein without departing from the spirit and scope of the present invention as claimed.

What is claimed is:

1. A copy paper delivery timer control device in an electrophotographic copying machine comprising:

scanner means for optically scanning an original document at variable speeds according to a selected magnification ratio, said scanner means being movable from a home position past leading and trailing edges of the original document, said document having first and second portions defined by a dividing line intermediate said leading and trailing edges, wherein said first portion extends from said leading edge to said dividing line and said second portion extends from said dividing line to said trailing edge;

home position sensing means for detecting when said scanner means is in said home position;

pulse generating means for generating a predetermined number of pulses representing the travelling distance of said scanner means from said home position to said leading edge and from said home position to said dividing line intermediate said leading and trailing edges, respectively;

counter means for counting said predetermined number of pulses produced by said pulse generating means from said home position to said leading edge and from said home position to said dividing line;

copy paper delivery means for delivering copy paper from a paper feed location to an image transfer location, wherein said image transfer location begins the point at which either a first or second portion of an optically scanned original document image is transferred to said copy paper;

timer means, independently operable of said counter means, for determining an amount of time required for said document image to reach said image transfer location and for separately determining an amount of time required for said copy paper to reach said image transfer location from said paper feed location;

means for aligning a tip position of said first document image portion with a tip position of said copy paper at said image transfer location, wherein the amount of time required for said copy paper to reach said image transfer location is substracted from the amount of time required for said document image to reach said image transfer location subsequent to counting said predetermined number of pulses generated by said scanning means from said home position to said leading edge.

2. A copy paper delivery timer control device according to claim 1, further including means for aligning a tip position of said second document image portion with a tip position of said copy paper at said image transfer location, wherein the amount of time required for said copy paper to reach said image transfer location is subtracted from the amount of time required for said document image to reach said image transfer location subsequent to counting said predetermined number of pulses generated by said scanner means from said home position to said dividing line.

* * * * *